US008041272B2

(12) United States Patent
Nedelin

(10) Patent No.: US 8,041,272 B2
(45) Date of Patent: Oct. 18, 2011

(54) DRUM POSITIONING SYSTEM

(75) Inventor: Peter A. Nedelin, Ashdod (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 401 days.

(21) Appl. No.: 12/249,236

(22) Filed: Oct. 10, 2008

(65) Prior Publication Data

US 2009/0116879 A1 May 7, 2009

Related U.S. Application Data

(60) Provisional application No. 60/985,975, filed on Nov. 6, 2007.

(51) Int. Cl.
*G03G 15/16* (2006.01)

(52) U.S. Cl. ..... 399/297; 399/121; 271/274

(58) Field of Classification Search ..... 399/297, 399/121, 361; 271/274
See application file for complete search history.

(56) References Cited

U.S. PATENT DOCUMENTS

| | | | | |
|---|---|---|---|---|
| 3,273,199 | A | 9/1966 | Kleinewefers | |
| 4,848,765 | A * | 7/1989 | Torii | 271/274 |
| 5,893,017 | A * | 4/1999 | Yamamoto | 399/299 |
| 6,011,947 | A | 1/2000 | Acquaviva et al. | |
| 6,282,403 | B1 | 8/2001 | Spencer et al. | |
| 6,308,820 | B1 * | 10/2001 | Munneke | 198/626.2 |
| 6,606,945 | B1 | 8/2003 | Shimatsu et al. | |
| 6,817,611 | B2 * | 11/2004 | DiRamio | 271/273 |
| 2007/0053718 | A1 * | 3/2007 | Choi | 399/159 |
| 2007/0228647 | A1 * | 10/2007 | Hara | 271/272 |
| 2008/0131163 | A1 * | 6/2008 | Lombardo et al. | 399/110 |

* cited by examiner

*Primary Examiner* — David Gray
*Assistant Examiner* — G. M. Hyder

(57) ABSTRACT

Various embodiments and methods adjust and maintain a relative positioning and/or pressure between a first drum and a second drum using first and second bearers coupled to the first and second drums, respectively, and at least one spacer mechanism between the first and second bearers.

21 Claims, 6 Drawing Sheets

DRUM POSITIONING SYSTEM

This application claims the benefit of U.S. provisional patent application Ser. No. 60/985,975, filed on Nov. 6, 2007, entitled "DRUM POSITIONING SYSTEM".

BACKGROUND

Pairs of drums are sometimes used to transfer material or to interact with material between such drums. Such drums sometimes include run out or other dimensional inconsistencies. These dimensional inconsistencies may cause inconsistent relative positioning and compressive pressures between the drums.

DETAILED DESCRIPTION OF THE EXAMPLE EMBODIMENTS

Figure 1:
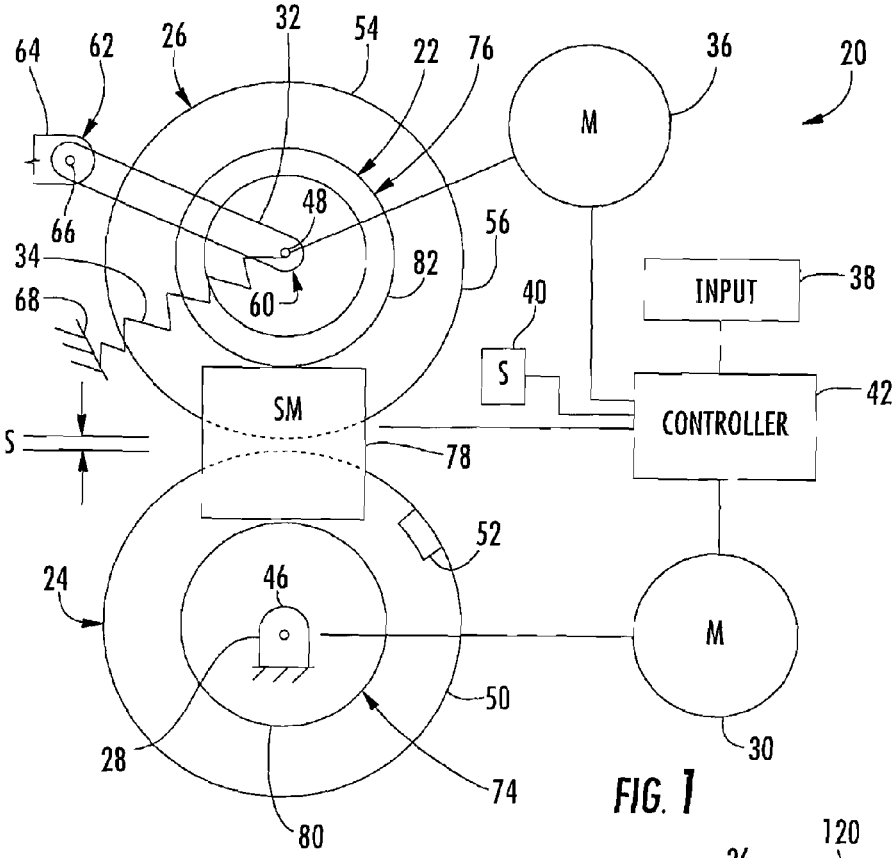
FIG. 1 is a schematic illustration of an apparatus including a positioning system according to an example embodiment.

FIG. 1 schematically illustrates an apparatus 20 including a positioning system 22 and drums 24, 26 according to an example embodiment. Drums 24, 26 are configured to either transfer material from one drum to another drum or to interact with a material or medium passing therebetween. As will be described hereafter, positioning system 22 facilitates adjustment and control of the relative positioning and compressive pressure between drums 24 and 26.

In addition to drums 24, 26 and positioning system 22, apparatus 20 further includes support 28, drum drive 30, support 32, bias 34, drum drive 36, input 38, sensor 40 and Controller 42. As shown by FIG. 1, drums 24, 26 comprise cylinders rotationally supported opposite to one another. In the example illustrated, drum 24 is rotationally supported about a fixed or stationary axis 46. Drum 26 is rotationally supported about a movable axis 48. In the example illustrated, drum 24 includes an outer surface 50 that is generally circumferential or round except for one or more non-round outer surface portions 52. Non-round outer surface portion 52 comprises a notch, opening or recess along surface 50. In other embodiment, portion 52 may comprise a flat or may comprise a projection or protuberance. Similar to drum 24, drum 26 has an outer surface 54 that is substantially circumferential or round except for one or more non-round outer surface portions 56. In the example illustrated, portions 56 comprise a flat. In other embodiments, drums 54 may omit non-round outer surface portions or may include additional or alternative non-round outer surface portions.

Support 28 (schematically illustrated) comprises a substantially stationary structure rotationally supporting drum 50 about axis 46. Drum drive 30 comprises a mechanism configured to rotationally drive drum 24 about axis 46. In the example illustrated, drum drive 30 comprises a step or motor facilitating controlled rotation of drum 24. In other embodiments, drum drive 30 may comprise other forms of motors or rotational actuators. In yet other embodiments where drum 24 freely rotates, drum drive 30 may be omitted.

Support 32 comprises a structure configured to movably support axis 48 and drum 26 relative to axis 46 and drum 24. In the particular example illustrated, support 32 comprises an extension or arm having a first end 60 rotationally supporting drum 26 and a second end or portion 62 rotationally or pivotally connected to another support 64 about axis 66. Support 64 (schematically shown) comprises a stationary or fixed structure thoroughly supporting arm 32 and drum 26. In other embodiments, drum 26 and its rotational axis 48 may be movably supported relative to drum 24 in other fashions. For example, in lieu of being pivotably supported, drum 26 may alternatively be configured to translate or slide towards and away from drum 24.

Bias 34 comprises a mechanism coupled between arm 32 and support 68 and configured to resiliently urge arm 32 in a clock-wise direction about axis 66 (as seen in FIG. 1) so as to also urge drum 26 towards drum 24. Bias 34 assists in maintaining positioning of drum 26 relative to drum 24 despite vibration or shock. In one embodiment, apparatus 20 includes a pair of such biases 34 located proximate to opposite axial ends of drum 26. Support 68 comprises any stationary fixed structure and may be part of support 46 or support 64.

In the example illustrated, bias 34 comprises a tension spring connected between arm 32 and support 68. In other embodiment, bias 34 may comprise a compression spring coupled between arm 32 and a support (not shown) on an opposite side of axis 66. In still other embodiment, bias 34 may comprise a torsion spring connected between support 64 and arm 32 about axis 66. In some embodiments, bias 34 may be omitted such as where gravity is employed to urge drum 26 towards drum 24.

Drum drive 36 comprises a source of torque operably coupled to drum 26 so as to rotationally drive drum 26 about axis 48. In the example illustrated, drum drive 36 comprises a motor. In one embodiment, drum drive 36 comprises a stepper motor, providing precise control over rotational positioning of drum 26. In other embodiments, drum drive 36 may comprise other sources of torque. In some embodiment, drum drive 36 may be omitted.

Positioning system 22 comprises a system or arrangement of components or structures configured to adjust relative positioning and pressure between drum 24 and drum 26 and to maintain a selected relative positioning and pressure despite run out or other dimensional inconsistencies of drums 24, 26. Positioning system 22 includes bearer 74, bearer 76 and spacer mechanism 78.

Bearer 74 comprises a cylindrical member, projection, hub or other structure coupled to drum 24 so as to rotate with drum 24 about axis 46. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. Bearer 74 includes an outer circumferential surface 80 configured to bear against, abut, contact or engage portions of spacer mechanism 78.

Bearer 76 is similar to bearer 74. Bearer 76 comprises a cylindrical member, projection, hub or other structure coupled to drum 26 so as to rotate with drum 26 about axis 48. Bearer 76 comprises a cylindrical member, projection, hub or other structure coupled to drum 26 so as to rotate with drum 26 about axis 46. Bearer 76 includes an outer circumferential surface 82 configured to bear against, abut, contact or engage portions of spacer mechanism 78. Although bearers 74, 76 are illustrated as having substantially the same diameter, in other embodiments, bearers 74, 76 may have different diameters.

Spacer mechanism 78 comprises one or more components between bearers 74 and 76 in mutual engagement with surfaces 80 and 82 that continuously extend across the gap or space between opposed portion of surfaces 80 and 82 so as to space bearers 74 and 76 from one another. As a result, spacer mechanism 78 also controls either the space S between the outer surfaces 50 and 54 of drums 24 and 26, respectively, or the amount of pressure exerted by drum 54 upon drum 52 (and any intermediate structure, media or material) or vice versa. Spacer mechanism 78 maintains a selected spacing or distance between bearers 74, 76 to maintain a desired space or pressure between drums 24, 26. In addition, spacer mechanism 78 is configured to be adjusted or actuated between different states in which opposed portions of surfaces 80 and 82 of bearers 74 and 76 are differently spaced from one another. As a result, spacer mechanism 78 may be adjusted to select a desired spacing or a desired compressive pressure between drums 24 and 26.

For example, in one embodiment, spacer mechanism 78 may be actuated to a first state in which bearers 74 and 76 are spaced such that opposed portions of surfaces 50 and 54 are also spaced by a first distance greater than zero. In another embodiment, spacer mechanism 78 may be actuated to a second state in which bearers 74 and 76 are spaced such that opposed portions of surfaces 50 and 54 are also spaced by second distance greater than zero and different than the first distance. In another embodiment, spacer mechanism 78 may be actuated to a third state in which bearers 74 and 76 are spaced such that opposed portions of surfaces 50 and 54 are in contact with one another with a first pressure being applied across surfaces. In another embodiment, spacer mechanism 78 may be actuated to a second state in which bearers 74 and 76 are spaced such that opposed portions of surfaces 50 and 54 are in contact with one another or are in contact with an intermediate structure or medium, wherein a second compressive pressure, different than the first pressure, is applied across such surfaces or across the intermediate structure or medium.

According to one embodiment, positioning system 22 includes an identical set of bearers 74, 76 and an identical spacer mechanism 78 on an opposite axial end of drums 24, 26. In one embodiment, spacer mechanisms 78 on opposite axial ends of drums 24, 26 are independently adjustable or actuatable so as to provide distinct spaces between the pairs of bearers 74, 76 on the opposite axial ends. As a result, different spacings or different pressures may be provided at different locations along the axis of drum 24 or drum 26. In other embodiments, the opposite spacer mechanisms 78 may actuate together in substantial unison. In still other embodiments, positioning system 22 may include a single set of bearers 74, 76 and a single spacer mechanism 78.

Input 38 comprises one or more devices configured to facilitate entering of commands or instructions to controller 42 by a person or operator. Input 38 facilitates entry of commands directing controller 42 to generate control signals actuating the one or more spacer mechanism 78 to selected states such provide a desired spacing and/or pressure between drums 24, 26. Examples of input 38 include, but are not limited to, a keyboard, a keypad, a touchscreen, a touchpad, one or more switches, a one or more slider bars, a mouse, a stylus, and a microphone with associated speech recognition hardware or software. Input 38 may also comprise an external communication port for receiving commands from an external device that is across a network, the internet or other communication mediums. In some embodiments, input 38 may be omitted.

Sensor 40 comprises one or more sensing devices located and configured to sense or detect a spacing between surfaces 80, 82, a spacing between surfaces 50, 54 or a pressure being applied or occurring between surfaces 50, 52. Sensor 40 provides feedback to controller 42, enabling controller 42 to adjust the settings of spacer mechanism 78 to achieve a desired spacing or pressure result. In other embodiments, sensor 40 may be omitted.

Controller 42 comprises one or more processors or processing units configured to generate control signals which cause spacer mechanism 78 to be actuated between different states in which spacer mechanism 78 spaces bearers 74, 76 by different distances. In the example illustrated, controller 42 is further configured to receive and analyze feedback from sensors 40 to adjust spacer mechanism 78 to achieve a desired spacing or pressure. In the example illustrated, controller 42 is also configured to adjust the relative positioning or pressure between drums 24 and 26 based upon command instructions received via input 38.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 42 may be embodied as part of one or more application-specific integrated circuits (ASICs). Unless otherwise specifically noted, the controller is not limited to any specific combination of hardware circuitry and software, nor to any particular source for the instructions executed by the processing unit. In addition to generating control signals actuating spacer mechanism 78, controller 42 may also generate control signals directing drum drives 30 and 36 to rotationally drive drums 24 and 26, respectively. Controller 42 may also generate control signals directing other operations of apparatus 20.

Overall, positioning system 22 facilitates constant contact between bearers 74, 76 for shockless rotation of drums 24 and 26. Positioning system 22 permits the spacing or pressure between surfaces 50, 54 of drums 24 and 26, respectively, to be rapidly adjusted. Spacer mechanism 78 facilitates automatic adjustment in response to control signals from controller 42 based upon instructions contained within an associated memory, commands received via input 38 are feedback received via sensor 40. In particular embodiments, the spacing or pressure at opposite axial ends of drums 24 and 26 may be independently adjusted. At the same time, the pressure or spacing may be maintained despite run out or dimensional inconsistencies in one or both of drums 24, 26.

Figure 2:
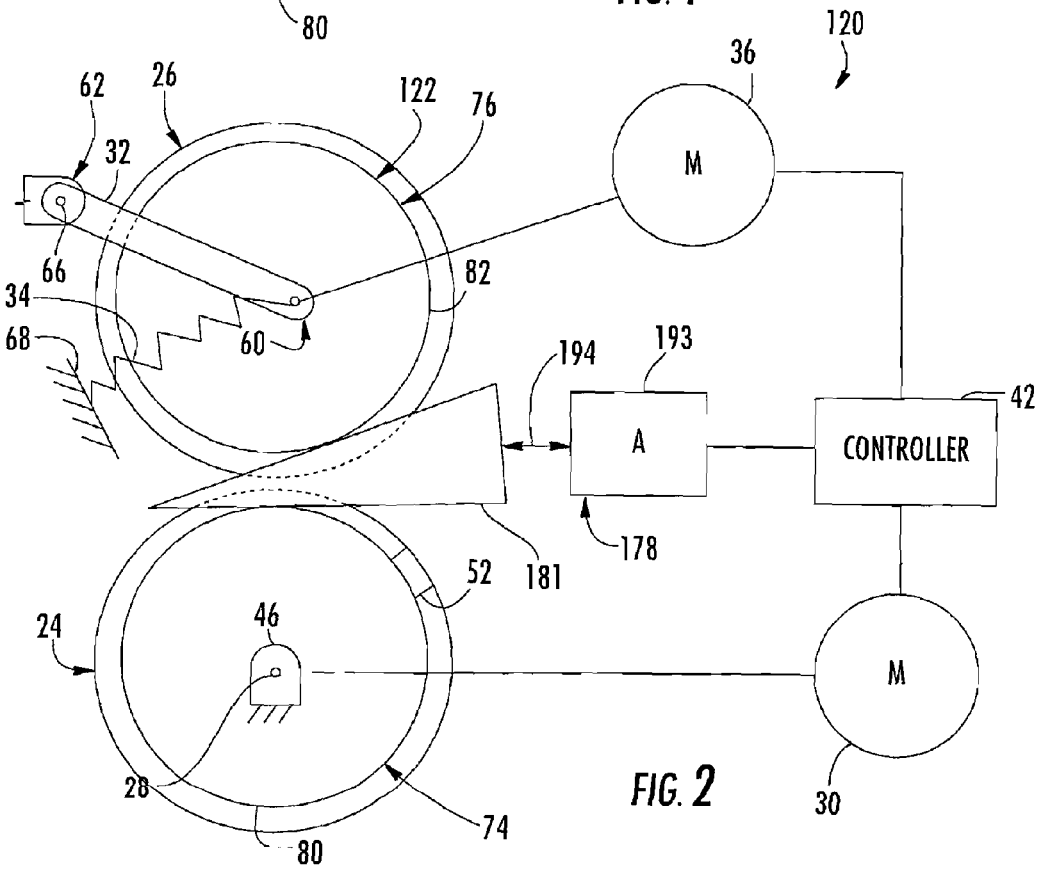
FIG. 2 is a schematic illustration of another embodiment of the apparatus of FIG. 1 including another embodiment of the positioning system according to an example embodiment.

FIG. 2 schematically illustrates apparatus 120, another embodiment of apparatus 20. Apparatus 120 is similar to apparatus 20 except that apparatus 120 includes positioning system 122 instead of positioning system 22. Those remaining structures or components of system 120 which correspond to structures or components of system 20 are numbered similarly.

Positioning system 122 includes bearers 74, 76, as generally described above with respect to FIG. 1, and a pair of spacer mechanisms 178 (one of which is shown) which are located at opposite axial ends of drums 24, 26. Spacer mechanism 178 adjusts and maintains the spacing between surfaces 80 and 82 of bearers 74 and 76, respectively. Spacer mechanism 178 includes spacer 181 and actuation system 193. The spacer 181 comprises one or more structures continuously extending between surfaces 80 and 82 of bearers 74 and 76, respectively, that are configured to have a changing dimension between surfaces 80 and 82 in response to being moved relative to surfaces 80 and 82 while remaining in contact with surfaces 80 and 82. In the example illustrated, spacer 181 comprises a wedge extending between and mutually engaging surfaces 80 and 82. Movement of wedge 181 in either direction as indicated by arrows 194 changes the spacing between surfaces 80 and 82 and also changes the spacing between surfaces 50 and 54 of drums 24 and 26 or the pressure between surfaces 50 and 54 of drums 24 and 26, respectively. In the example illustrated, movement of spacer 181 to the left (as seen in FIG. 2) moves bearer 76 and its associated drum 26 against the bias provided by bias 34 away from bearers 74 and drum 24, increasing the gap or spacing between drums 24, 26 or decreasing the compressive force or pressure therebetween. Alternatively, movement of spacer 181 to the right (as seen in FIG. 2) permits bearer 76 and its associated drum 26 to move with the assistance of the bias provided by bias 34 towards bearers 74 and drum 24, decreasing the gap or spacing between drums 24, 26 or increasing the compressive force or pressure therebetween.

In one embodiment, the wedge of spacer 181 may include low friction surfaces in contact with surfaces 80 and 82 of bearers 74 and 76, respectively. For example, such surfaces may be formed from polytetrafluoroethylene. In another embodiment, such surfaces may be provided with rollers, ball bearings or other bearing mechanisms. Although the shape of spacer 181 is illustrated as a right triangle, in other embodiments, spacer 181 may have other shapes and configurations. Spacer 181 may have other configurations other than a wedge or triangle as well.

Actuation system 193 comprises a device configured to selectively move spacer 181 to the left or to the right so as to adjust spacing of bearers 74 and 76. In one embodiment, actuation system 193 may comprise a rack and pinion/worm gear arrangement powered by a motor, such as a two directional motor or a stepper motor, configured to linearly translate spacer 181. In another embodiment, actuation system 193 may comprise a hydraulic or pneumatic cylinder-piston assembly or an electric solenoid. In yet another embodiment, actuation system 193 may comprise one or more motor driven cams which facilitate translation of spacer 181 in either of the directions indicated by arrows 194. As shown by FIG. 2, actuator 183 translates or moves spacer 181 in response to control signals received from controller 42.

Figure 3:
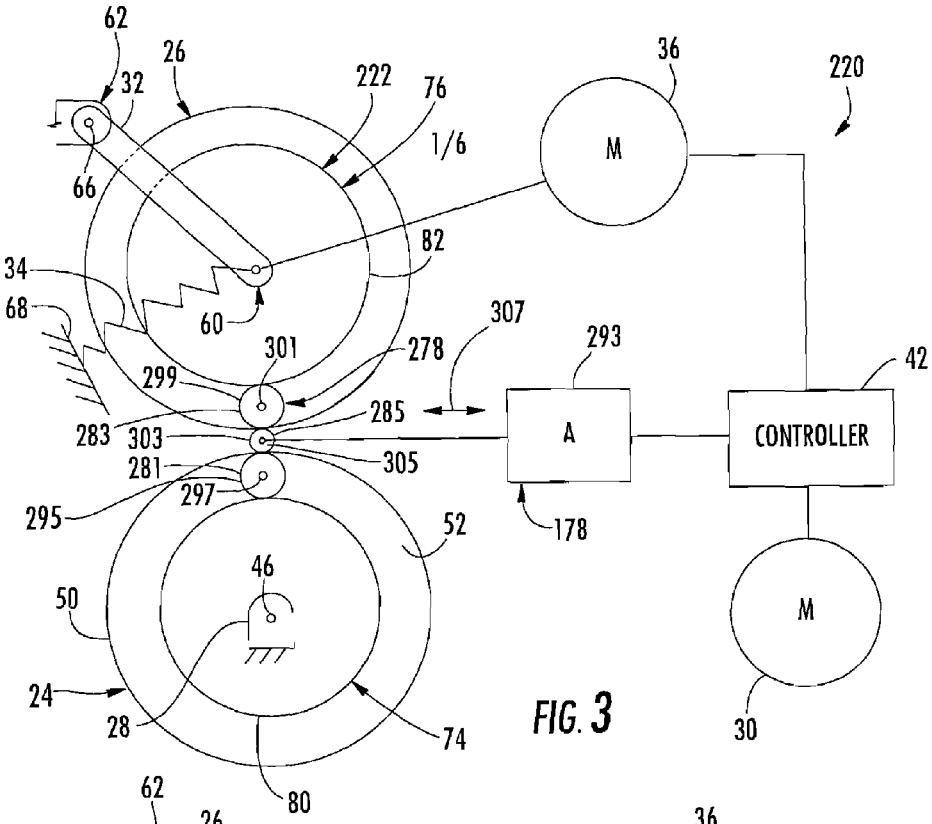
FIG. 3 is a schematic illustration of another embodiment of the apparatus of FIG. 1 including another embodiment of the positioning system according to an example embodiment.

FIG. 3 schematically illustrates apparatus 220, another embodiment of apparatus 20 shown in FIG. 1. Apparatus 220 is similar to apparatus 20 except that apparatus 220 includes positioning system 222 instead of positioning system 22. Those remaining structures or components of system 220 which correspond to structures or components of system 20 are numbered similarly.

Positioning system 222 includes bearers 74, 76, as generally described above with respect to FIG. 1, and a pair of spaced spacer mechanisms 278 (one of which is shown) which are located at opposite axial ends of drums 24, 26. Spacer mechanism 278 adjusts and maintains the spacing between surfaces 80 and 82 of bearers 74 and 76, respectively. Spacer mechanism 278 includes spacers 281, 283, 285 and actuation system 293. Spacer 281 comprises a roller having an outer circumferential surface 295 in mutual contact with surface 80 of bearer 74 and spacer 285. Spacer 281 rotates about a generally fixed or stationary axis 297.

Spacer 283 comprises a roller having an outer circumferential surface 299 in mutual contact with surface 82 of bearer 76 and spacer 285. Spacer 283 rotates about an axis 301 that is movably supported between bearer 76 and bearer 74. For example, in one embodiment, spacer 283 may rotate about an axis 301 that is provided by a shaft that is permitted to rotate and slide or move vertically with a substantially vertical channel or slot provided by a support structure or frame structure, such as support 68. As a result, bias 34 urges error 76 against spacer 283 which is moved so as to abut and bear against spacer 285.

Spacer 285 comprises a roller having an outer circumferential surface 303 in mutual contact with surface 299 of spacer 283 and surface 295 of spacer 281. In the example illustrated, spacer 303 is rotationally supported about axis 305. In other embodiments, spacer 285 may comprise a cylinder having a low friction out of circumferential surface, the cylinder being fixed against rotation.

Actuation system 293 comprising mechanism operably coupled to spacer 285 sets to selectively move spacer 285 in either of the directions indicated by arrows 307 relative to spacers 281 and 283. Such movement of spacer 285 adjusts the spacing between spacers 281 and 283. As a result, such movement of spacer 285 further adjusts the spacing between bearers 74 and 76 to cause adjustment of the relative positioning or compression pressures between drums 24 and 26.

According to one embodiment, actuation system 293 may comprise a rack and pinion arrangement powered by a motor, such as a two directional motor or a stepper motor, configured to linearly translate spacer 285. In another embodiment, actuation system 293 may comprise a hydraulic or pneumatic cylinder-piston assembly or an electric solenoid. In yet another embodiment, actuation system 293 may comprise one or more motor driven cams which facilitate translation of spacer 285 in either of the directions indicated by arrows 307. As shown by FIG. 3, actuation system 293 translates or moves spacer 285 in response to control signals received from controller 42.

Figure 4:
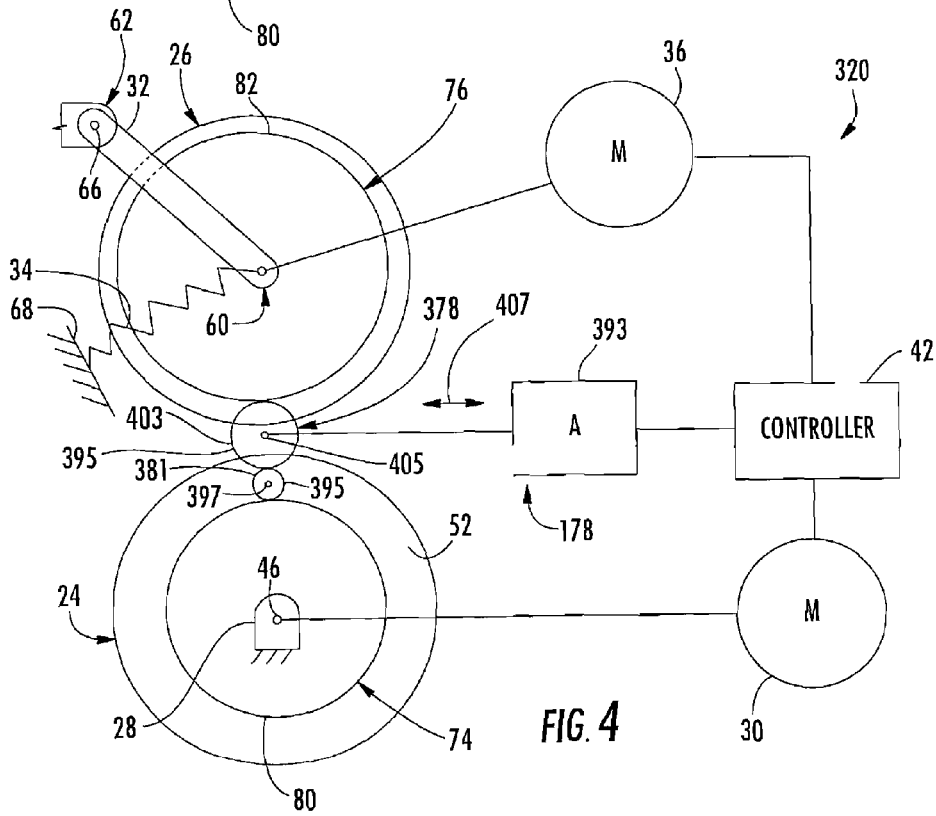
FIG. 4 is a schematic illustration of another embodiment of the apparatus of FIG. 1 including another embodiment of the positioning system according to an example embodiment.

FIG. 4 schematically illustrates apparatus 320, another embodiment of apparatus 20 shown in FIG. 1. Apparatus 320 is similar to apparatus 20 except that apparatus 320 includes positioning system 322 instead of positioning system 22. Those remaining structures or components of system 320 which correspond to structures or components of system 20 are numbered similarly.

Positioning system 322 includes bearers 74, 76, as generally described above with respect to FIG. 1, and a pair of spaced spacer mechanisms 378 (one of which is shown) which are located at opposite axial ends of drums 24, 26. Spacer mechanism 378 adjusts and maintains the spacing between surfaces 80 and 82 of bearers 74 and 76, respectively. Spacer mechanism 378 includes spacers 381, 385 and actuation system 393. Spacer 381 comprises a roller having an outer circumferential surface 395 in mutual contact with surface 80 of bearer 74 and spacer 285. Spacer 381 rotates about a generally fixed or stationary axis 397.

Spacer 385 comprises a roller having an outer circumferential surface 403 in mutual contact with surface 82 of spacer 76 and surface 395 of spacer 381. In the example illustrated, spacer 303 is rotationally supported about axis 405. In other embodiments, spacer 385 may comprise a cylinder having a low friction outer circumferential surface, the cylinder being fixed against rotation.

Actuation system 393 comprising mechanism operably coupled to spacer 385 sets to selectively move spacer 385 in either of the directions indicated by arrows 407 relative to bearer 76 and spacer 381. Such movement of spacer 385 adjusts the spacing between spacers 381 and bearer 76. As a result, such movement of spacer 385 further adjusts the spacing between bearers 74 and 76 to cause adjustment of the relative positioning or compression pressures between drums 24 and 26.

According to one embodiment, actuation system 393 may comprise a rack and pinion arrangement powered by a motor, such as a two directional motor or a stepper motor, configured to linearly translate spacer 385. In another embodiment, actuation system 393 may comprise a hydraulic or pneumatic cylinder-piston assembly or an electric solenoid. In yet another embodiment, actuation system 393 may comprise one or more motor driven cams which facilitate translation of spacer 385 in either of the directions indicated by arrows 407. As shown by FIG. 4, actuation system 393 translates or moves spacer 385 in response to control signals received from controller 42.

Figure 6:
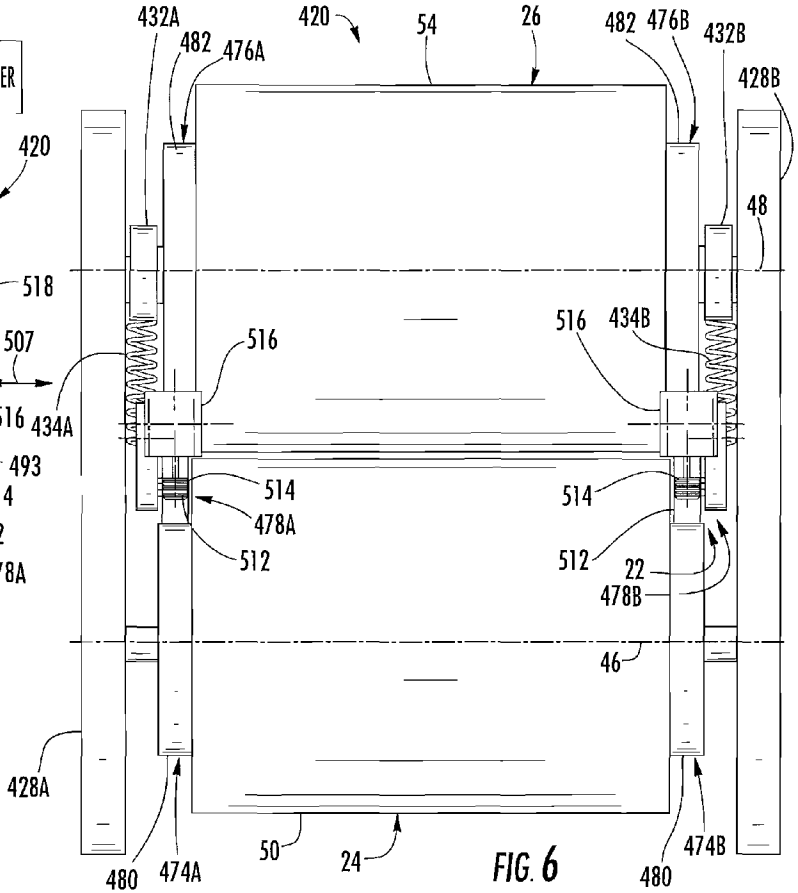
FIG. 6 is a slight elevational view of the apparatus and the positioning system of FIG. 5 according to an example embodiment.
Figure 5:
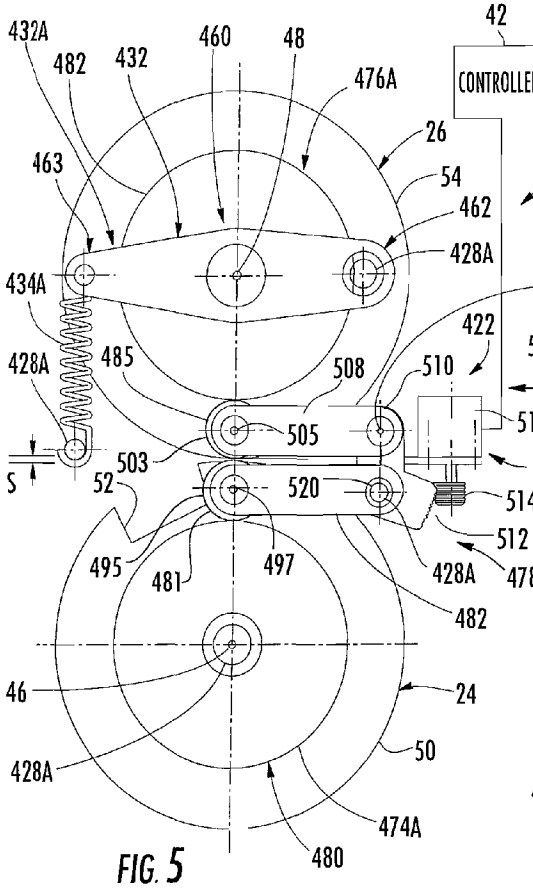
FIG. 5 is an end elevational view of another embodiment of the apparatus of FIG. 1 including another embodiment of the positioning system according to an example embodiment.

FIGS. 5-8 illustrate apparatus 420, another embodiment of apparatus 20 (shown in FIG. 1). As shown by FIGS. 5 and 6, apparatus 420 includes positioning systems 422, a particular embodiment of positioning system 22 (shown in FIG. 1). In addition, apparatus or 420 also includes drums 24, 26 (described above with respect to apparatus 20), supports 428A, 428B (collectively referred to as supports 428), drum drive 30 (shown and described above with respect to FIG. 1), arms 432A, 432B (collectively referred to as arms 432), biases 434A, 434B (collectively referred to as biases 434), drum drive 36 (shown and described above with respect to FIG. 1), input 38 (shown and described above with respect to FIG. 1), sensor 40 (shown and described above with respect to FIG. 1) and controller 42 (described above with respect to FIG. 1).

Supports 428 comprise a pair of substantially stationary structures at opposite ends of drums 24, 26. Supports 428 rotationally support drum 24 about axis 46. Arms 432 comprise structures at opposite ends of drum 26 that are configured to movably support axis 48 and drum 26 relative to axis 46 and drum 24. In the particular example illustrated, each of arms 432 comprises an extension having a first central portion 460 (shown in FIG. 5) rotationally supporting drum 26, a first end or portion 462 (shown in FIG. 5) rotationally or pivotally connected to an associated support 428A or 428B about axis 466, and a second end or portion 463 pivotally connected to one of biases 434. In other embodiments, drum 26 and its rotational axis 48 may be movably supported relative to drum 24 in other fashions. For example, in lieu of being pivotably supported, drum 26 may alternatively be configured to translate or slide towards and away from drum 24.

Biases 434 comprise mechanisms coupled between arms 432 and supports 428 and configured to resiliently urge arms 432 in a counter-clock-wise direction about axis 466 (as seen in FIG. 5) so as to also urge drum 26 towards drum 24. Biases 434 assist in maintaining positioning of drum 26 relative to drum 24 despite vibration or shock.

In the example illustrated, biases 434 comprise tension springs connected between arms 432 and supports 428. In other embodiments, biases 434 may comprise a compression springs coupled between arms 432 and a portion of one of supports 428 on an opposite side of axis 466. In still other embodiment, biases 434 may comprise torsion springs coupled between supports 428 and arms 432 about axis 466. In some embodiments, biases 434 may be omitted such as where gravity is employed to urge drum 26 towards drum 24.

Positioning system 222 comprises a system or arrangement of components or structures configured to adjust relative positioning and pressure between drum 24 and drum 26 and to maintain a selected relative positioning and pressure despite run out or other dimensional inconsistencies of drums 24, 26. Positioning system 422 includes bearers 474A, 474B (collectively referred to as bears 474), bearers 476A, 476B (collectively referred to as bearers 476) and spacer mechanisms 478A, 478B (collectively referred to as spacer mechanisms 478).

Bearers 474 and 476 are similar to bearers 74 and 76 described above. Bearers 474 comprises a cylindrical member, projection, hub or other structure coupled to drum 24 so as to rotate with drum 24 about axis 46. Bearers 474 include an outer circumferential surface 480 configured to bear against, abut, contact or engage portions of spacer mechanisms 478.

Bearer 476 is similar to bearer 474. Bearer 476 comprises a cylindrical member, projection, hub or other structure coupled to drum 26 so as to rotate with drum 26 about axis 48. Bearers 476 include an outer circumferential surface 482 configured to bear against, about, contact or engage portions of spacer mechanisms 478. Although bearers 474, 476 are illustrated as having substantially the same diameter, and other embodiment, bearers 474, 476 may have different diameters.

Spacer mechanisms 478 comprises one or more components between bearers 474 and 476 in mutual engagement with surfaces 480 and 482 that continuously extend a cross the gap or space between opposed portion of surfaces 480 and 482 so as to space bearers 474 and 476 from one another. Spacer mechanisms 478 maintain a selected spacing or distance between bearers 474, 476 to maintain a desire space or pressure between drums 24, 26. In addition, spacer mechanisms 478 are configured to be adjusted or actuated between different states in which opposed portions of surfaces 480 and 482 of bearers 474 and 476 are differently spaced from one another. As a result, spacer mechanism 78 may be adjusted to select a desired spacing or a desired compressive pressure between drums 24 and 26.

According to one embodiment, each of spacer mechanisms 478 is adjustable or actuatable independent of the other spacer mechanism 478. As a result, the left end of drums 24, 26 may be at a distinct spacing or distinct pressure as compared to the right end of drums 24, 26. In yet another embodiment, spacer mechanisms 478 are alternatively configured to uniformly space bearers 474 and 476 at opposite ends of drums 24 and 26 such that a uniform pressure or spacing exists actually across drums 24 and 26.

In the example illustrated, each of spacer mechanisms 478 each includes spacer 481, support arm 482, spacer 485 and actuation system 493. Spacer 481 comprises a cylindrical member or roller rotationally supported by support arm 482 about axis 497. Spacer 481 has an outer circumferential surface 495 in mutual contact with surfaces 480 of bearers 474 and spacer 485. In the example illustrated, spacer 481 rotates about a generally fixed or stationary axis 497.

Support arm 482 comprises a rigid structure rotationally supporting spacer 481. In one embodiment, arms 482 extend from supports 428. In other embodiment, arms 482 may extend from other structures. In a particular example illustrated, arms 482 also support portions of actuation system 493. In other embodiments, separate structures may be provided for supporting actuation system 493.

Spacer 485 comprises a roller having an outer circumferential surface 503 in mutual contact with surface 482 of bearers 476 and surface 495 of spacer 481. In the example illustrated, spacer 485 is rotationally supported about axis 505. In other embodiments, spacer 485 may comprise a cylinder having a low friction outer circumferential surface, the cylinder being fixed against rotation.

Actuation systems 493 comprise mechanisms operably coupled to spacer 485 and configured to selectively move spacers 485 in either of the directions indicated by arrows 507 relative to bearers 476 and spacers 481. Such movement of spacers 485 adjusts the spacing between spacers 481 and bearers 476. As a result, such movement of spacers 485 further adjusts the spacing between bearers 474 and 476 to cause adjustment of the relative positioning or compression pressures between drums 24 and 26.

In the particular example illustrated, actuation system 493 includes support arm 508, lever arm 510, rack gear 512, worm gear 514 and motor 516. Support arm 508 comprises an arm or elongate structure rotationally supporting spacer 45 about axis 505 and pivotally connected to lever arm 510 about axis 518. Lever arm 510 comprises an angled arm pivotally connected to arm 508 about axis 518 and pivotally supported about axis 520. In the particular example illustrated, lever arm 510 is pivotally supported by support arm 482. In other embodiment, lever arm 512 may be pivotally supported about a fixed axis 520 by other stationary structures. Pivoting of lever arm 510 results in movement of arm 508 and spacer 485 in one of the directions indicated by arrows 507.

Rack gear 510, worm gear 514 and motor 516 form an actuator configured to selectively pivot lever arm 510 and move spacer 485. Rack gear 512 comprises a rack gear coupled to lever arm 510. Worm gear 514 is in meshing engagement with rack gear 512 and is operably coupled to motor 516 so as to be rotationally driven by motor 516. Motor 516 comprises a rotary actuator. In particular, motor 516 comprises a two directional motor, such as a stepper motor, configured to rotate worm gear 514 in either direction so as to pivot lever arm 510 and move spacer 485.

In other embodiments, other actuators may alternatively be used to pivot lever arm 510. For example, a rack and pinion gear arrangement may alternatively be employed. In still other embodiments, a hydraulic or pneumatic cylinder-piston assembly or an electric solenoid pivotally connected to lever arm 510 may be employed. In still other embodiment, lever arm 510 may be omitted where an actuator is provided that directly moves spacer 485. For example, arm 508 may be directly connected to a rack and pinion arrangement, a hydraulic or pneumatic cylinder-piston assembly, an electric solenoid or a motor driven cam arrangement.

Figure 7:
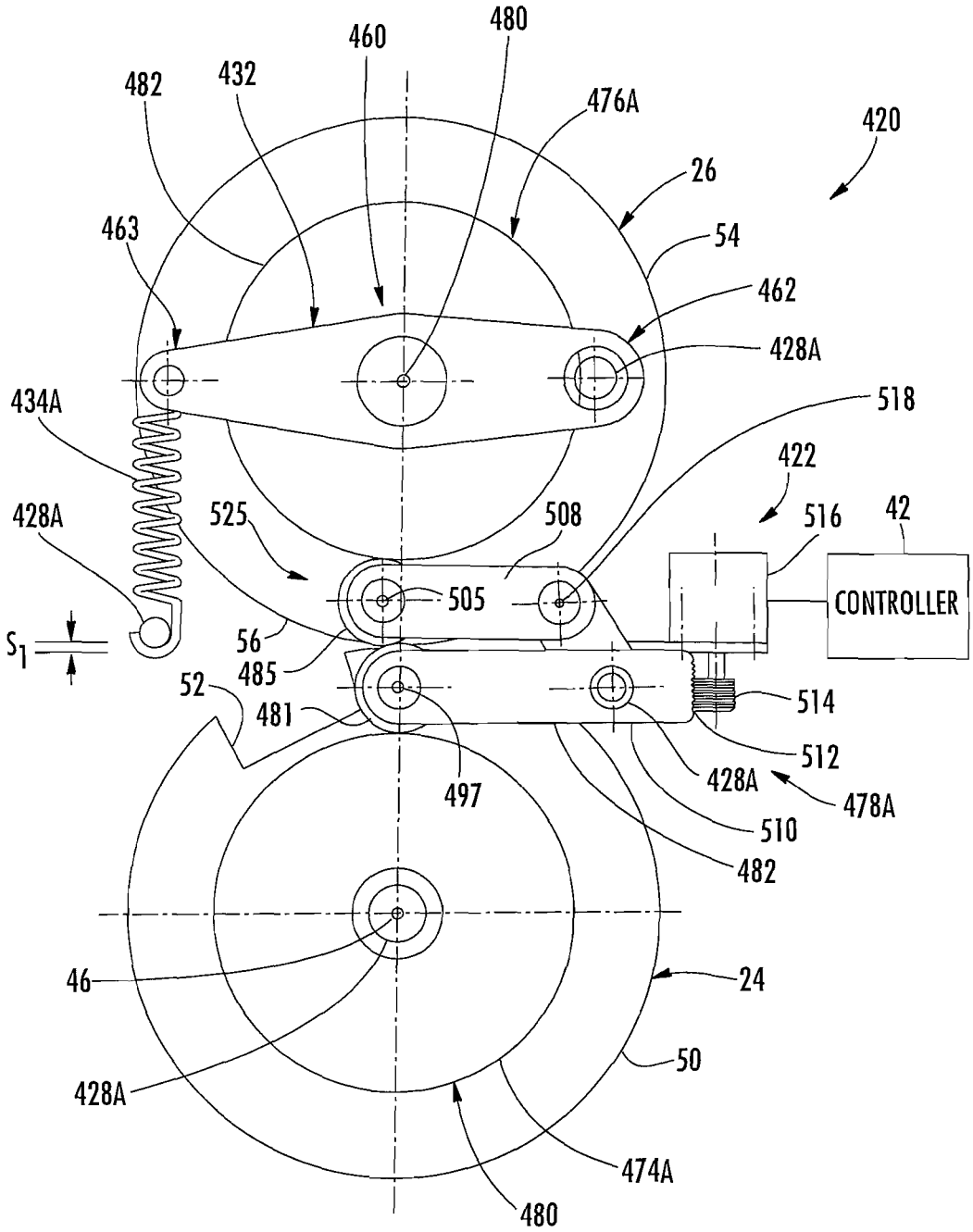
FIG. 7 is an end elevational view of the apparatus of FIG. 5 illustrating the positioning system in a first position according to an example embodiment.
Figure 8:
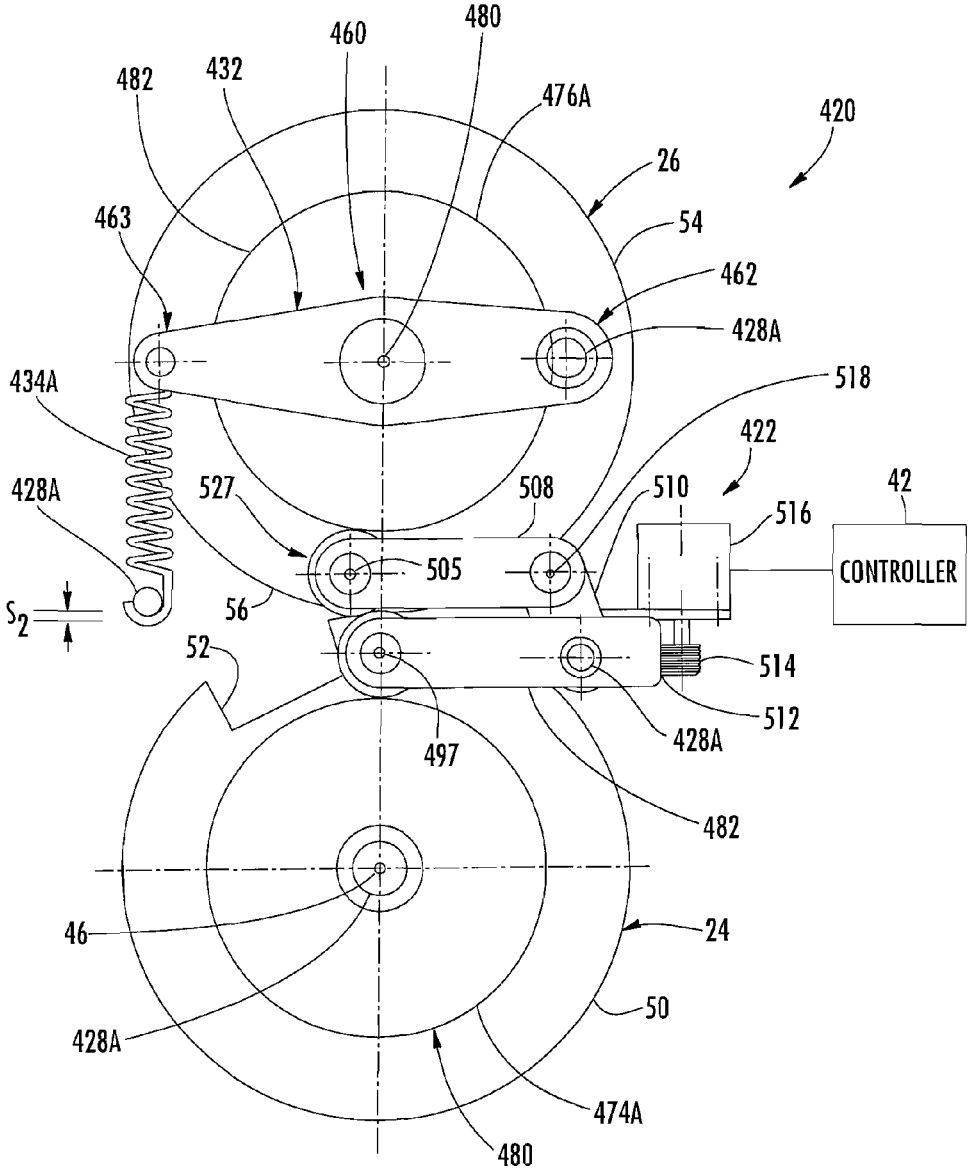
FIG. 8 is an end elevational view of the apparatus of FIG. 5 illustrating the positioning system in a second position according to an example embodiment.

FIGS. 7 and 8 illustrate operation of positioning system 422. As shown by FIG. 7, in response to control signals received from controller 42, motor 516 of spacer mechanism 478A rotationally drives worm gear 514 to pivot lever arm 510 so as to locate spacer 485 at a first position 525 with respect to spacer 481 and bearer 476. As a result, the left end of drums 24, 26 (as seen in FIG. 6) has surfaces 50 and 54 spaced from one another by a distance S1. In a similar fashion, motor 516 of spacer mechanism 478B (shown in FIG. 6) may similarly rotationally drive its associated worm gear 514 to pivot its associated lever arm 510 so as to locate spacer 485 at a first position 525 with respect to spacer 481 and bearer 476. As a result, the right end of drums 24, 26 (as seen in FIG. 6) also has surfaces 50 and 54 spaced from one another by a distance S1. Alternatively, the right end of drums 24, 26 may be spaced by a distinct distance.

As shown in FIG. 8, in response to control signals received from controller 42, motor 516 of spacer mechanism 478A rotationally drives worm gear 514 to pivot lever arm 510 so as to locate spacer 485 at a second position 527, distinct from the first position 525 (further to the left as seen in FIG. 8), with respect to spacer 481 and bearer 474A. As a result, the left end of drums 24, 26 (as seen in FIG. 6) has surfaces 50 and 54 spaced from one another by a distance S2. In a similar fashion, motor 516 of spacer mechanism 478B (shown in FIG. 6) may similarly rotationally drive its associated worm gear 514 to pivot its associated lever arm 510 so as to locate spacer 485 at a first position 527 with respect to spacer 481 and bearer 476. As a result, the right end of drums 24, 26 (as seen in FIG. 6) also has surfaces 50 and 54 spaced from one another by a distance S2. Alternatively, the right end of drums 2426 may be spaced by a distinct distance. As shown by FIGS. 7 and 8, the spacing between drums 24 and 26 may be set at any one of a multitude of different spacings along a continuous spectrum or range.

Although FIGS. 7 and 8 illustrate two distinct spacings S1 and S2 that may be established by positioning system 422, in other embodiments, positions 525 and 527 may both result in contact between surfaces 50 and 54 of drums 24 and 26 or positions in which drums 24 and 26 impose forces on one another across one or more intermediate structures or mediums between drums 24 and 26, respectively. However, at position 525, distinct compressor forces may be exerted between drums 24, 26 as compared to when spacer 485 is at position 527. Likewise, in other embodiments, distinct compressive pressures may be achieved across the axial length of drums 24, 26 by varying the positions of spacer is at opposite ends of drums 24 and 26.

Figure 9:
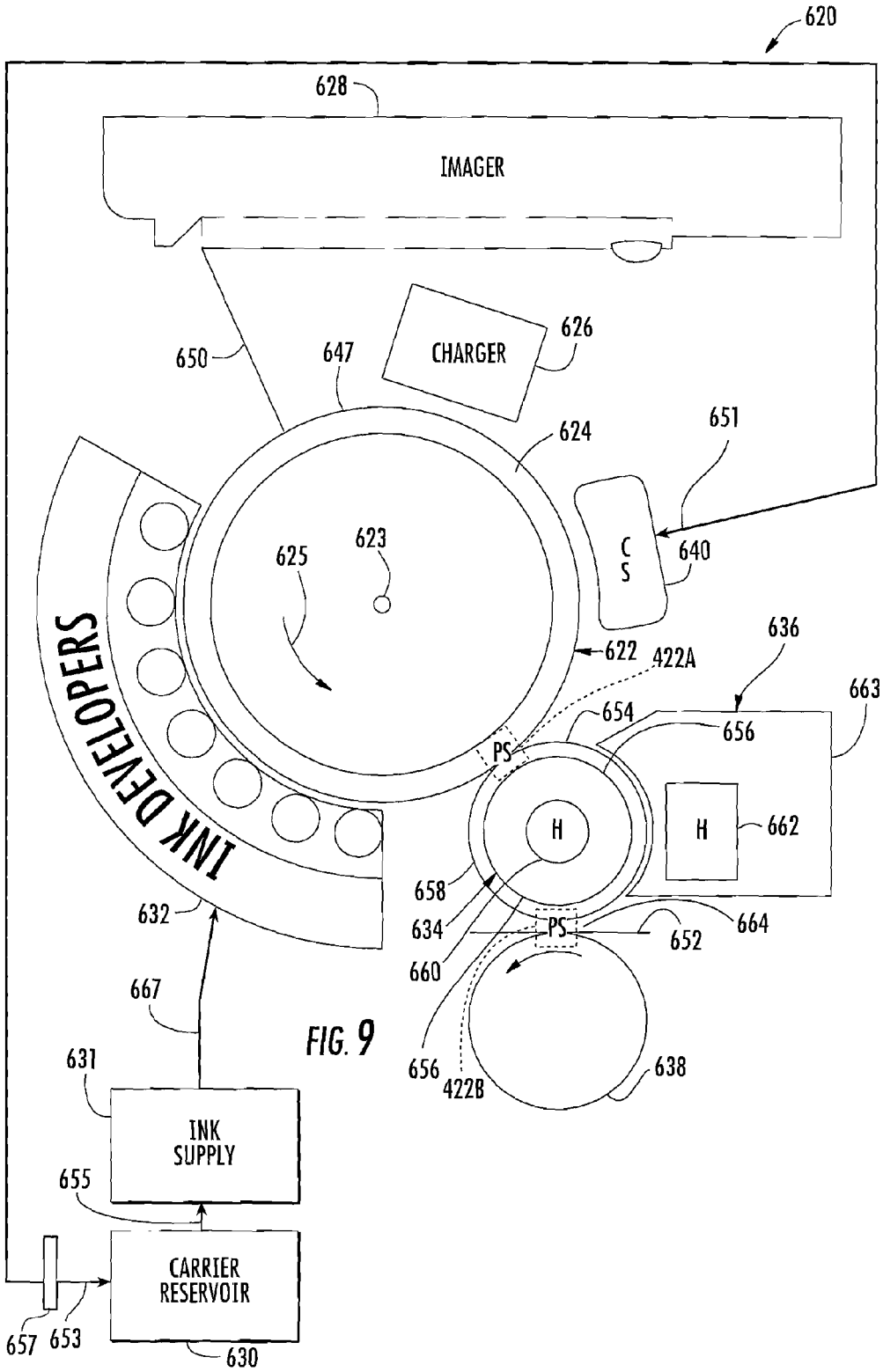
FIG. 9 is a schematically station of a printer including the positioning system of FIGS. 5 and 6 according to an example embodiment.

FIG. 9 schematically illustrates imaging system or printer 620 including positioning systems 422A, 422B (collectively referred to as positioning systems 422) according to an example embodiment. Printer 620 comprises a liquid electrophotographic (LEP) printer. Printer 620, (sometimes embodied as part of an offset color press) includes drum 622 including photoconductor 624, charger 626, imager 628, ink carrier oil reservoir 630, ink supply 631, developer 632, internally and/or externally heated intermediate transfer member 634, impression member 638, cleaning station 640, condenser 642, separator 144 and additive system 146. Drum 622 comprises a movable support structure including photoconductor 624. Photoconductor 624, also sometimes referred to as a photoreceptor, comprises a multi-layered structure configured to be charged and to have portions selectively discharged in response to optical radiation such that charged and discharged areas form a discharged image to which charged printing material is adhere. Drum 622 is configured to be rotationally driven about axis 623 in a direction indicated by arrow 625 by a motor and transmission (not shown). As a result, distinct surface portions of photoconductor 624 are transported between stations of printer 620 including charger 626, imager 628, ink developers 132, transfer member 634 and charger 634.

Charger 626 comprises a device configured to electrostatically charge surface 647 of photoconductor 624. In one embodiment, charger 626 comprises a charge roller which is rotationally driven while in sufficient proximity to photoconductor 624 so as to transfer a negative static charge to surface 647 of photoconductor 624. In other embodiments, charger 626 may alternatively comprise one or more corotrons or scorotrons. In still other embodiments, other devices for electrostatically charging surface 647 of photoconductor 624 may be employed.

Imager 628 comprises a device configured to selectively electrostatically discharge surface 647 so as to form an image. In the example shown, imager 628 comprises a scanning laser which is moved across surface 647 as drum 622 and its photoconductor 624 are rotated about axis 623. Those portions of surface 647 which are impinged by light or laser 650 are electrostatically discharged to form an image (or latent image) upon surface 647. In other embodiments, imager 628 may alternatively comprise other devices configured to selectively emit or selectively allow light to impinge upon surface 647. For example, in other embodiments, imager 628 may alternatively include one or more shutter devices which employ liquid crystal materials to selectively block light and to selectively allow light to pass to surface 647. In yet other embodiments, imager 628 may alternatively include shutters which include micro or nano light-blocking shutters which pivot, slide or otherwise physically move between a light blocking and light transmitting states.

Ink carrier reservoir 630 comprises a container or chamber configured to hold ink carrier oil for use by one or more components of printer 620. In the example illustrated, ink carrier reservoir 630 is configured to hold ink carrier oil for use by cleaning station 640 and ink supply 631. In one embodiment, as indicated by arrow 651, ink carrier reservoir 630 serves as a cleaning station reservoir by supplying ink carrier oil to cleaning station 640 which applies the ink carrier oil against photoconductor 624 to clean the photoconductor 624. In one embodiment, cleaning station 640 further cools the ink carrier oil and applies ink carrier oil to photoconductor 624 to cool surface 647 of photoconductor 624. For example, in one embodiment, cleaning station 640 may include a heat exchanger or cooling coils in ink care reservoir 630 to cool the ink carrier oil. In one embodiment, the ink carrier oil supply to cleaning station 640 further assists in diluting concentrations of other materials such as particles recovered from photoconductor 624 during cleaning.

After ink carrier oil has been applied to surface 647 to clean and/or cool surface 647, the surface 647 is wiped with an absorbent roller and/or scraper. The removed carrier oil is returned to ink carrier reservoir 130 as indicated by arrow 653. In one embodiment, the ink carrier oil returning to ink carrier reservoir 630 may pass through one or more filters 657 (schematically illustrated). As indicated by arrow 655, ink carrier oil in reservoir 630 is further supplied to ink supply 631. In other embodiments, ink carrier reservoir 630 may alternatively operate independently of cleaning station 640, wherein ink carrier reservoir 630 just supplies ink carrier oil to ink supply 631.

Ink supply 631 comprises a source of printing material for ink developers 632. Ink supply 631 receives ink carrier oil from carrier reservoir 630. As noted above, the ink carrier oil supplied by ink carrier reservoir 630 may comprise new ink carrier oil supplied by a user, recycled ink carrier oil or a mixture of new and recycling carrier oil. Ink supply 631 mixes being carrier oil received from ink care reservoir 630 with pigments or other colorant particles. The mixture is applied to ink developers 632 as needed by ink developers 632 using one or more sensors and solenoid actuated valves (not shown).

In the particular example shown, the raw, virgin or unused printing material may comprise a liquid or fluid ink comprising a liquid carrier and colorant particles. The colorant particles have a size of less than 2μ. In different embodiments, the particle sizes may be different. In the example illustrated, the printing material generally includes approximately 3% by weight, colorant particles or solids part to being applied to surface 147. In one embodiment, the colorant particles include a toner binder resin comprising hot melt adhesive.

In one embodiment, the liquid carrier comprises an ink carrier oil, such as Isopar, and one or more additional components such as a high molecular weight oil, such as mineral oil, a lubricating oil and a defoamer. In one embodiment, the printing material, including the liquid carrier and the colorant particles, comprises HEWLETT-PACKARD ELECTRO INK commercially available from Hewlett-Packard.

Ink developers 632 comprises devices configured to apply printing material to surface 647 based upon the electrostatic charge upon surface 647 and to develop the image upon surface 647. According to one embodiment, ink developers 632 comprise binary ink developers (BIDs) (commercially available from Hewlett-Packard) circumferentially located about drum 622 and photoconductor 624. Such ink developers are configured to form a substantially uniform 6μ thick electrostatically charged film composed of approximately 20% solids which is transferred to surface 647. In yet other embodiments, ink developers 632 may comprise other devices configured to transfer electrostatically charged liquid printing material or toner to surface 647. In still other embodiments, developers 632 may be configured to apply a dry electrostatically charged printing material, such as dry toner, to surface 147.

Intermediate transfer member 634 comprises a drum configured to transfer the printing material upon surface 647 to a print medium 652 (schematically shown). Intermediate transfer member 634 includes an exterior surface 654 which is resiliently compressible and which is also configured to be electrostatically charged. Because surface 654 is resiliently compressible, surface 654 conforms and adapts to irregularities in print medium 652. Because surface 654 is configured to be electrostatically charged, surface 654 may be charged so as to facilitate transfer of printing material from surface 647 to surface 654. In one embodiment, intermediate transfer member 634 may include a an external blanket 658. Blanket 658 which provides intermediate transfer member 634 with surface 654.

Heating system 636 comprises one or more devices configured to apply heat to printing material being carried by surface 654 from photoconductor 624 to medium 652. In the example illustrated, heating system 636 includes internal heater 660, external heater 662 and vapor collection plenum 663. Internal heater 660 comprises a heating device located within drum 656 that is configured to emit heat or inductively generate heat which is transmitted to surface 654 to heat and dry the printing material carried at surface 654. External heater 662 comprises one or more heating units located about transfer member 634. According to one embodiment, heaters 660 and 662 may comprise infrared heaters.

Heaters 660 and 662 are configured to heat printing material to a temperature of at least 85° C. and less than or equal to about 110° C. In still other embodiments, heaters 660 and 662 may have other configurations and may heat printing material upon transfer member 634 to other temperatures. In particular embodiments, heating system 636 may alternatively include one of either internal heater 660 or external heater 662.

Vapor collection plenum 663 comprises a housing, chamber, duct, vent, plenum or other structure at least partially circumscribing intermediate transfer member 634 so as to collect or direct ink or printing material vapors resulting from the heating of the printing material on transfer member 634 for discharge or to a condenser (not shown) or discharge or recycling.

Impression member 638 comprises a cylinder adjacent to intermediate transfer member 634 so as to form a nip 664 between member 634 and member 638. Medium 652 is generally fed between transfer member 634 and impression member 638, wherein the printing material is transferred from transfer member 634 to medium 652 at nip 664.

Cleaning station 640 comprises one or more devices configured to remove any residual printing material from photoconductor 624 prior to surface areas of photoconductor 624 being once again charged at charger 626. In one embodiment, cleaning station 640 may comprise one or more devices configured to apply a cleaning fluid to surface 647, wherein residual toner particles are removed by one or more is absorbent rollers. In one embodiment, cleaning station 640 may additionally include one or more scraper blades. In yet other embodiments, other devices may be utilized to remove residual toner and electrostatic charge from surface 647.

In operation, heating system 636 applies heat to such printing material upon surface 654 so as to evaporate the carrier liquid of the printing material and to melt toner binder resin of the color and particles or solids of the printing material to form a hot melt adhesive. Thereafter, the layer of hot colorant particles forming an image upon surface 654 is transferred to medium 652 passing between transfer member 634 and impression member 638. In the embodiment shown, the hot colorant particles are transferred to print medium 652 at approximately 90° C. The layer of hot colorant particles cool upon contacting medium 652 on contact in nip 664.

These operations are repeated for the various colors or preparation of the final image to be produced upon medium 652. In other embodiments, in lieu of creating one color separation at a time on a surface 654, sometimes referred to as "multi-shot" process, the above process may be modified to employ a one-shot color process in which all color separations are layered upon surface 654 of intermediate transfer member 634 prior to being transferred to and deposited upon medium 652.

In printer 620, positioning systems 422A is employed to control or regulate the spacing between drum 622 and intermediate transfer member 634. Positioning system 422B is employed to control or regulate the spacing or compressive pressure between intermediate transfer member 634 and impression member 138. In other embodiments, printer 620 may alternatively omit one of positioning systems 422.

According to one embodiment, drum 122 is pivotally supported relative to supports 428 (shown in FIG. 6) by arms 432 (shown in FIG. 6) while being resiliently biased towards intermediate transfer member 634 by biases 434 (shown in FIG. 6). In operation, controlled movement of spacer 485 (shown in FIG. 5) adjusts relative positioning and drum 622 and intermediate transfer member 634.

According to one embodiment, the drum of impression member 138 is pivotally supported by supports, such as supports 428 (shown in FIG. 6) while being resiliently biased towards intermediate transfer member 634 by biases 434 (shown in FIG. 6). In operation, controlled movement of spacer 485 (shown in FIG. 5) adjusts relative positioning of member 638 and intermediate transfer member 634.

In yet another embodiment, drum 622 is pivotally supported relative to supports 428 (shown in FIG. 6) by arms 432 (shown in FIG. 6) while being resiliently biased towards intermediate transfer member 634 by biases 434 (shown in FIG. 6). In operation, controlled movement of spacer 485 (shown in FIG. 5) adjusts relative positioning and drum 122 and intermediate transfer member 634. At the same time, the intermediate transfer member 638 is pivotally supported by supports, such as supports 428 (shown in FIG. 6) while being resiliently biased towards impression member 638 by biases 434 (shown in FIG. 6). In operation, controlled movement of spacer 485 (shown in FIG. 5) adjusts relative positioning of member 638 and intermediate transfer member 634.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a first drum;

a second drum; and a positioning system configured to adjust relative positioning and pressure between the first drum and the second drum and to maintain a selected relative positioning and pressure despite run out of either of the first drum or the second drum, wherein the positioning system comprises:

a first bearer coupled to the first drum so as to rotate with the first drum, the first bearer having a first diameter less than a diameter of the first drum;

a second bearer coupled to the second drum so as to rotate with the second drum, the second bearer having a second diameter less than a diameter of the second drum;

a first spacer mechanism in engagement with the first bearer and the second bearer, the first spacer mechanism being actuatable between a first state in which the first bearer and the second bearer are spaced by the first spacer mechanism by a first distance and a second state in which the first bearer and the second bearer are spaced by the spacer mechanism by a second distance different than the first distance, wherein the first spacer mechanism is proximate a first axial end of the first drum and a second spacer mechanism in engagement with the first bearer and the second bearer proximate a second axial end of the first drum, the second spacer mechanism being actuatable between a first state in which the first bearer and the second bearer are spaced by the second spacer mechanism by a third distance and a second state in which the first bearer and the second bearer are spaced by the second spacer mechanism by a fourth distance different than the third distance, wherein the second spacer comprises:

a first roller in contact with the first bearer; and a second roller in contact with the second bearer and the first roller, wherein the second roller rotates about a first axis that is configured to be adjustably positioned with respect to the first roller and the first bearer.

2. The apparatus of claim 1, wherein the positioning system includes a powered actuator to adjust the positioning and pressure.

3. The apparatus of claim 1, wherein the first spacer mechanism and the second spacer mechanism are independently adjustable and configured such that the first spacer mechanism spaces the first bearer and the second bearer by a first spacing at the first axial end of the first drum and such that the second spacer mechanism spaces the first bearer and the second bearer by a second spacing at the second axial end of the first drum.

4. The apparatus of claim 1, wherein the first bearer is pivotally supported relative to the second bearer.

5. The apparatus of claim 4, wherein the first bearer is resiliently biased towards the second bearer.

6. The apparatus of claim 1 further comprising an actuation system for moving the first axis of the second roller.

7. The apparatus of claim 6, wherein the actuation system comprises:

a first arm rotatably supporting the second roller;

a second arm configured to pivot about a second axis and pivotally connected to the first arm about a third axis; and an actuator for selectively pivoting the second arm.

8. The apparatus of claim 7, wherein the actuator comprises:

a rack gear associated with the second arm;

a worm gear in engagement with the rack gear; and a motor operably coupled to the worm gear.

9. The apparatus of claim 1, wherein the first bearer and the second bearer each comprise a fully round outer circumferential surface.

10. The apparatus of claim 1 further comprising a developer configured to transfer toner onto one of the first drum and the second drum.

11. The apparatus of claim 1, wherein the first drum and the second drum are configured to receive therebetween a medium to be printed upon.

12. The apparatus of claim 1, wherein at least one of the first drum and the second drum includes non-round outer surface portions.

13. The apparatus of claim 1, wherein at least one of the first drum and the second drum has a compressible outer surface.

14. The apparatus of claim 1, wherein the positioning system is configured to maintain a spacing greater than zero between outer surfaces of the first drum and the second drum.

15. A method comprising:

adjusting relative positioning and pressure between a first drum and a second drum at a first axial end of the first drum and at a second axial end of the first drum;

maintaining a first selected relative positioning and pressure between the first drum and the second drum at the first axial end despite run out of either of the first drum or the second drum; and maintaining a second selected relative positioning and pressure, different than the first selected relative positioning and pressure, between the first drum and the second drum at the second axial end despite run out of either of the first drum or the second drum using a positioning system comprising:

a first bearer associated with the first drum;

a second bearer associated with the second drum;

a first roller in contact with the first bearer; and a second roller in contact with the second bearer and the first roller, wherein the second roller rotates about a first axis that is configured to be adjustably positioned with respect to the first roller and the first bearer.

16. The method of claim 15, wherein the adjusting comprises changing a spacer mechanism in mutual engagement with a first bearer, associated with a first drum and having a first diameter less than a diameter of the first drum, and a second bearer, associated with a second drum and having a second diameter less than a diameter of the second drum.

17. An apparatus comprising:

a first drum;

a second drum; and a positioning system configured to adjust relative positioning and pressure between the first drum and the second drum and to maintain a selected relative positioning and pressure despite run out of either of the first drum or the second drum, wherein the positioning system comprises:

a first bearer associated with the first drum;

a second bearer associated with the second drum;

a first roller in contact with the first bearer; and a second roller in contact with the second bearer and the first roller, wherein the second roller rotates about a first axis that is configured to be adjustably positioned with respect to the first roller and the first bearer.

18. The apparatus of claim 17 further comprising an actuation system for moving the first axis of the second roller.

19. The apparatus of claim 18, wherein the actuation system comprises:

a first arm rotatably supporting the second roller;

a second arm configured to pivot about a second axis and pivotally connected to the first arm about a third axis; and an actuator for selectively pivoting the second arm.

20. The apparatus of claim 19, wherein the actuator comprises:

a rack gear associated with the second arm;

a worm gear in engagement with the rack gear; and a motor operably coupled to the worm gear.

21. The apparatus of claim 17, wherein the first bearer and the second bearer each comprise a fully round outer circumferential surface.

* * * * *